US005361825A

United States Patent [19]

Lax et al.

[11] Patent Number: 5,361,825

[45] Date of Patent: Nov. 8, 1994

[54] PLUG FOR METALLURGICAL VESSELS

[76] Inventors: Hermann Lax, Wittgatt 4, D-4000 Düsseldorf 31; Andreas Au, Am Driesenbusch 22, D-4100 Duisburg 18, both of Germany

[21] Appl. No.: 991,983

[22] Filed: Dec. 17, 1992

[30] Foreign Application Priority Data

Dec. 23, 1991 [DE] Germany ..... 4142773

[51] Int. Cl.[5] ..... B22D 41/18

[52] U.S. Cl. ..... 164/437; 222/603; 266/88; 164/151.4

[58] Field of Search ..... 164/437, 4.1, 337, 151.4; 222/603; 266/88

[56] References Cited

U.S. PATENT DOCUMENTS

| | | | |
|---|---|---|---|
| 3,200,457 | 8/1965 | Wagstaff | 164/337 |
| 3,357,250 | 12/1967 | Lowdermilk | 164/4.1 |
| 3,373,910 | 3/1968 | Murton | 222/592 |
| 3,413,852 | 12/1968 | Engel | 266/88 |
| 4,433,832 | 2/1984 | Butts | 266/87 |
| 4,691,901 | 9/1987 | Dobner | 266/236 |

FOREIGN PATENT DOCUMENTS

| | | | |
|---|---|---|---|
| 2546625 | 11/1984 | France | 164/4.1 |
| 583497 | 4/1932 | Germany . | |
| 2912311 | 10/1980 | Germany | 164/437 |
| 1022035 | 6/1983 | U.S.S.R. | 164/4.1 |

*Primary Examiner*—P. Austin Bradley
*Assistant Examiner*—Erik R. Puknys

[57] ABSTRACT

The invention relates to a plug made of refractory material for a metallurgical casting vessel. The plug 5, which can be formed with a central axial channel 5*b*, has an axial channel 5*d* which terminates eccentrically in front of the plug cap 5*a* and which is disposed in an axially extending rib 5*c* formed on the plug 5. A thermocouple 6 with its measuring cables is accommodated in said further axial channel 5*d*.

3 Claims, 2 Drawing Sheets

(I-I)

PLUG FOR METALLURGICAL VESSELS

Figure 1:
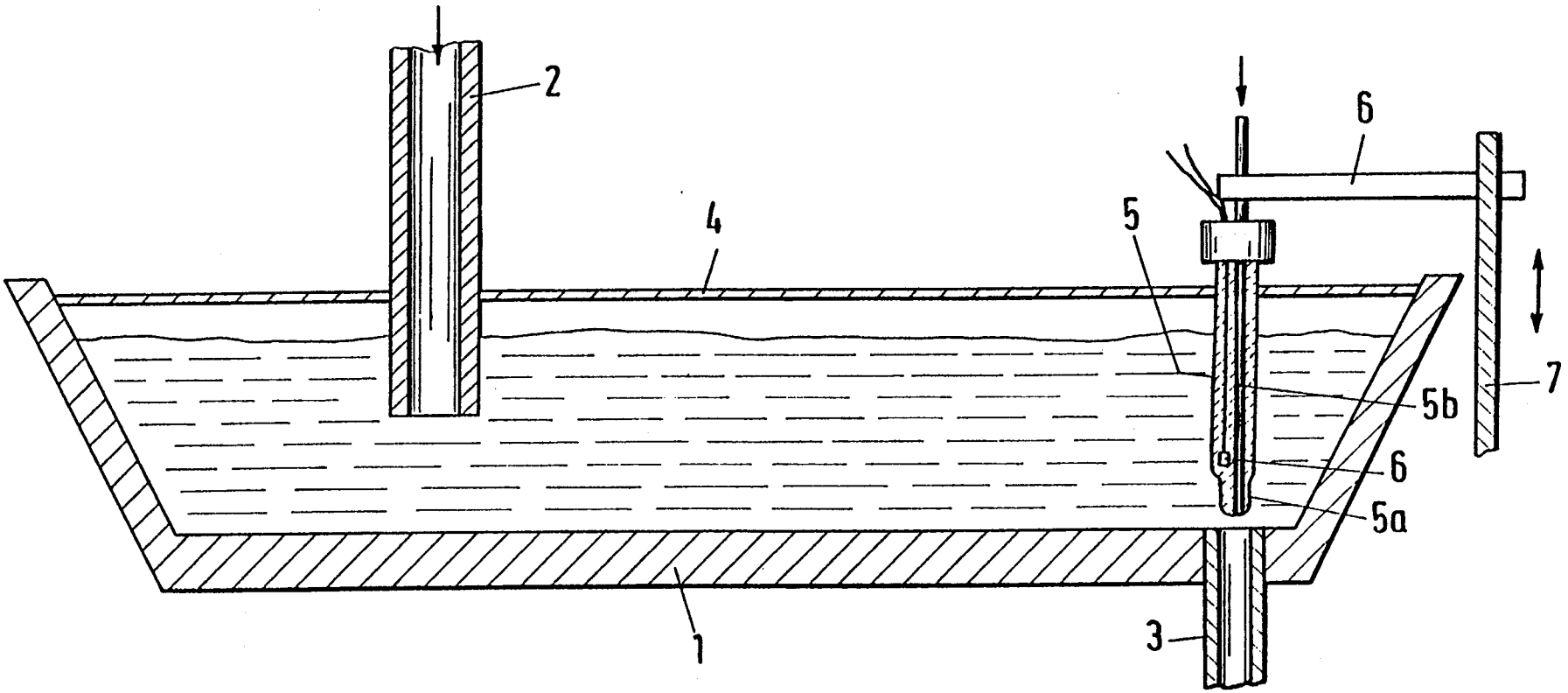

The invention relates to a plug made of refractory material in the form of a rod for a metallurgical casting vessel, the plug more particularly being formed with an axial channel for gas, additives and the like which extends to an outlet in the plug cap.

During casting it is important to monitor the casting temperature of the melt, more particularly of the melt leaving the casting vessel via its outlet. In a prior art casting vessel, therefore, a temperature measuring device in the form of a thermocouple disposed in a protective tube of refractory material is disposed between the outlet of the casting vessel and a casting jet protective tube supplying the melt. The protective tube is mounted on a cover of the casting vessel. The measuring device must be installed during the preparation of each casting. It is a complicated matter for the operatives to handle the protective tube on the cover of the casting vessel. Moreover, with thick slag covers on the molten steel, the protective tube, which has a thin wall due to the required low thermal insulation resistance, and the thermocouple disposed therein are easily damaged.

It is also known to accommodate the thermocouple with the measuring cables in a central axial channel, closed at the bottom, in a rod-shaped plug. The disadvantage of that kind of arrangement is that it is impossible to supply gas and/or additives to the melt via the plug, and due to the thick wall of the plug rod, the thermocouple indicates the temperature of the melt only with a certain delay and inaccurately.

It is an object of the invention to provide a device for measuring the temperature in a metallurgical casting vessel which is robust and can be cheaply manufactured and which indicates as accurately as possible the temperature of the melt leaving the casting vessel via the outlet.

This problem is solved according to the invention in a plug of the kind specified by the feature that the plug is formed eccentrically with an axial channel which terminates in front of the plug cap and in which a thermocouple with measuring cables is accommodated.

In the plug according to the invention the extra expense of accommodating the thermocouple in the measuring cables is only slight. The thermocouple with its measuring cables profits from the constructional robustness of the plug, which is required in any case. For this reason the wall thickness at the place where the thermocouple with the measuring cables is accommodated can be very small, something which meets the demand for as short a delay as possible in temperature measurement and for measuring accuracy. Also advantageously for measuring accuracy, the temperature is measured immediately in front of the outlet from the casting vessel. This is more particularly advantageous if the casting vessel has a number of outlets, as is the case with a multi-strand casting installation. In that case the temperature can be measured individually for each outlet. Lastly, the invention obviates the retaining and installation means required for the thermocouple and its supply cables. Since the axial channel for the thermocouple is disposed eccentrically in the plug, enough space is also left to accommodate the further axial channel for gas, additives or the like which extends to an outlet in the plug cap, so that the plug can perform a double function.

According to one feature of the invention the plug has above the plug cap an axially extending formed-on rib which is formed with the channel for the thermocouple. The rib is advantageous, since in that case a thin wall, more particularly a wall of uniform thickness, can be obtained over substantially half the periphery. The wall thickness of the rib should be 15 mm at the most.

Figure 2:
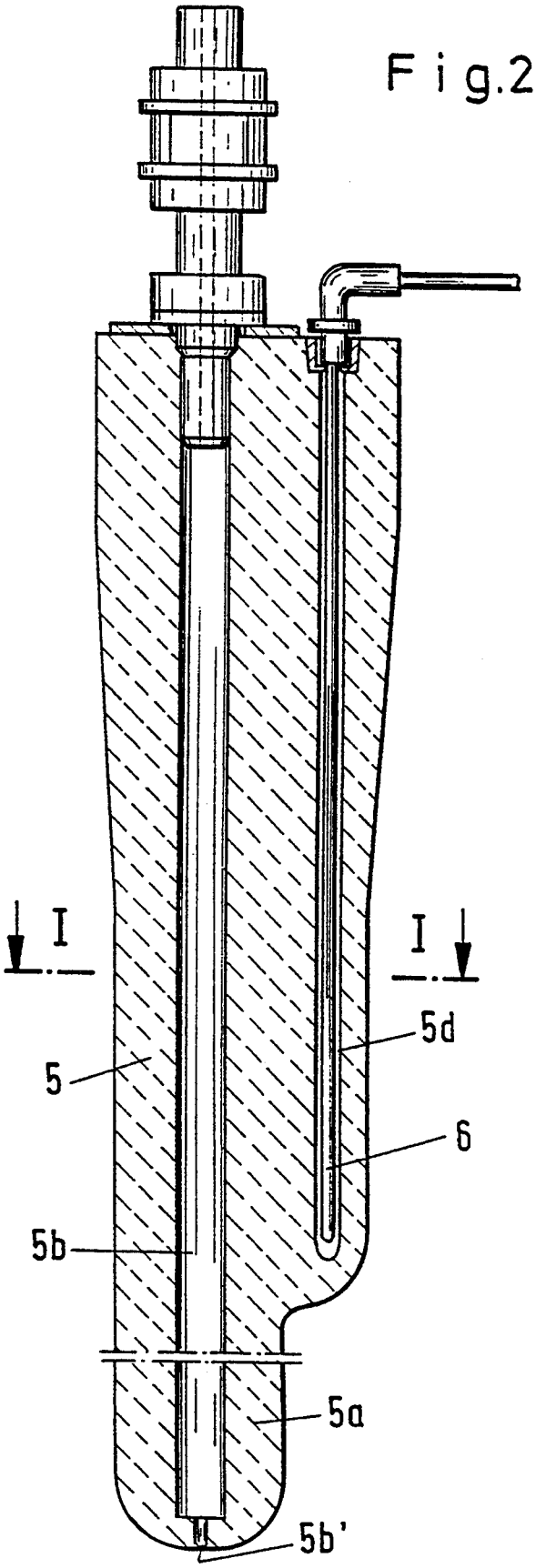
Figure 3:
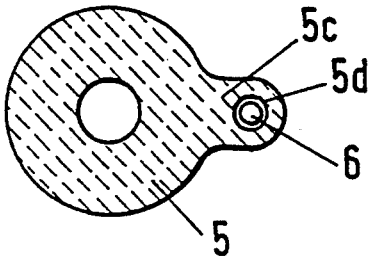

The invention will now be described in greater detail with reference to an embodiment thereof illustrated in the drawings, wherein:

FIG. 1 shows diagrammatically in vertical section and side elevation the casting vessel having a casting jet protective tube for the melt to be supplied and a plug, FIG. 2 is an axial section to an enlarged scale of the plug shown in FIG. 1, and FIG. 3 shows the plug illustrated in FIG. 2 in cross-section, taken along the line I—I in FIG. 2.

Molten metal is introduced into a casting vessel 1 via a casting jet protective tube 2 and in the flows out of the vessel 1 via an outlet 3. The casting vessel 1 is closed by a cover 4. A plug 5 in the form of a rod borne via a supporting arm 6 by a vertically reciprocable drive 7 is immersed into the melt via an opening in the cover 4. The outlet 3 can be closed by a plug cap 5*a* with which the lower end of the plug 5 is formed.

Extending through the plug 5, which is moulded from pressed refractory material, is an axial central channel 5*d* via which gas, additives or the like can be directly conveyed to the outlet 3 and added to the melt. The plug 5 has the basic shape of a circle in cross-section. Formed on the plug 5 above the plug cap 5*a* is a rib 5*c* in which a further axial channel 5*d* extends. A thermocouple 6 with its measuring cables is accommodated in the axial channel 5*d*. The wall of the channel 5*d* is comparatively thin, being 15 mm at the most. Since the thermocouple 6 is disposed directly above the plug cap 5*a* and the thickness of the wall is small on all sides in the zone of the thermocouple 6, and the thermocouple 6 is disposed with as small a clearance as possible in the channel 5*d*, the temperature of the melt leaving the casting vessel 1 via the outlet 3 is reliably determined very rapidly and with high accuracy.

The plug with integrated temperature measurement is inexpensive to produce. No extra expense is involved in the forming-on of the bulge 5*c* during the conventional pressing of the refractory material to produce the plug 5. The channel 5*d* is either drilled or produced during pressing.

We claim:

1. A metallurgical casting vessel, comprising a rod made from a refractory material having a central axis, said rod including a rib, said rod terminating in a plug cap, an eccentrically disposed axial channel in said rod, said eccentric axial channel being enclosed within a wall of said rod without any lateral channels extending from said eccentric axial channel in said wall, said eccentric axial channel being located within said rib, said eccentric axial channel terminating in front of said plug cap, and a thermocouple disposed within said eccentric axial channel, said plug further comprising an additional axial channel terminating in an outlet in said rod.

2. The plug of claim 1 wherein said rib has a wall thickness of at most 15 mm.

3. The plug of claim 1 wherein said additional axial channel is centrally disposed within said rod.

* * * * *